US006712658B1

(12) United States Patent
Crossley et al.

(10) Patent No.: US 6,712,658 B1
(45) Date of Patent: Mar. 30, 2004

(54) FLOATATION GARMENT

(75) Inventors: Philip Crossley, deceased, late of Northlincs (GB); by Howard Eric Culley, legal representative, Hartshead Sheffield (GB); by Hugh David Facey, legal representative, South Sheffield (GB); by John Edward McGee, legal representative, Fulwood Sheffield (GB)

(73) Assignee: Mullion Manufacturing, Ltd., North Lincolnshire (GB)

( * ) Notice: Subject to any disclaimer, the term of this patent is extended or adjusted under 35 U.S.C. 154(b) by 0 days.

(21) Appl. No.: 10/088,052

(22) PCT Filed: Sep. 21, 2000

(86) PCT No.: PCT/EP00/09443

§ 371 (c)(1),
(2), (4) Date: Jul. 25, 2002

(87) PCT Pub. No.: WO01/21475

PCT Pub. Date: Mar. 29, 2001

(30) Foreign Application Priority Data

Sep. 21, 1999 (GB) ..... 9922269
Dec. 24, 1999 (GB) ..... 9930838

(51) Int. Cl.[7] ..... B63C 9/115

(52) U.S. Cl. ..... 441/106; 441/104; 441/107; 441/108

(58) Field of Search ..... 441/106, 107, 441/114–119, 102–105; 2/458, 96

(56) References Cited

U.S. PATENT DOCUMENTS 3,230,545 A * 1/1966 Galley ..... 2/74
3,511,743 A 5/1970 Rach
4,137,586 A * 2/1979 Evert ..... 441/107
4,416,641 A * 11/1983 Spinosa et al. ..... 441/94

FOREIGN PATENT DOCUMENTS

GB 891 998 3/1962

* cited by examiner

*Primary Examiner*—Sherman Basinger
(74) *Attorney, Agent, or Firm*—Sughrue Mion, PLLC

(57) ABSTRACT

The floatation garment, in particular a lifejacket or an immersion suit, comprises at least one elastic layer (1) shaped to fit at least around the torso of a wearer and to stretch to an extent between a minimum and a maximum depending on the size of the wearer. To provide thermal insulation, it moreover comprises a plurality of thermally insulating panels (23–28), in particularly foam panels, which are attached with respect to the elastic layer (1) and/or with respect to one another such that they slidably overlap one another. In this way, the garment fits to persons of different size and keeps its thermal insulation notwithstanding the fact that the thermally insulating foam panels are not or not sufficiently elastic.

18 Claims, 9 Drawing Sheets

23
24
25
26
27
28
1
VII
VIII
IX
X

FLOATATION GARMENT

BACKGROUND OF THE INVENTION

The present invention relates to floatation garments such as lifejackets and immersion suits. More specifically the present invention relates to floatation garments provided with thermal insulation to safeguard the wearer from the potentially fatal consequences of immersion in cold water.

Lifejackets are provided for use in emergency situations, such as the sinking of a ship or the downing of an aircraft in water. As will be well understood a lifejacket gives the wearer additional buoyancy and helps to safeguard against drowning. Since, in an emergency situation, it is not possible to select ones lifejacket (one simply dons the lifejacket closest to hand), lifejackets follow the simple principle that one size fits all, at least for adults. At the upper and lower extremes this may cause problems, but generally all lifejackets are designed to fit 90% of the adult population. Variations in size are compensated for by securing ties on the lifejacket.

Following the tragic loss in the Baltic Sea of the roll on/roll off ferry Estonia, when there was considerable loss of life, a complete review of life saving procedures, standards and equipment took place. The circumstances surrounding the deaths of the unfortunate passengers drew attention to the need for a lifejacket which would not only support a person in water, but which would also materially assist in retaining important body warmth.

It is not generally appreciated that immersion in sea water, even in temperate climates, causes heat loss. Over a period of time, determined by the temperature of the sea and the persons size and weight, this leads to hypothermia and death follows quickly, either as a result of drowning because one is no longer able to support ones head out of the water or through heart failure. Research has shown that if a lifejacket is designed so that some of the required buoyancy also provides thermal protection of the torso and head, then the time the wearer will remain conscious in cold water is considerably extended from perhaps fifteen minutes to more than three hours. Thermal protection of the torso should include head, neck, armpits and groin, where the bloodstream is close to the skin and thermal protection is most important. The human body preserves body heat in a cold environment by reducing blood circulation in arms and legs. Thermal protection of these extremities is therefore less important.

Currently, the SOLAS lifejacket, which is the industry standard, provides buoyancy and materially helps to prevent a person from drowning. It will also support an unconscious person in a position where the mouth and nose are clear of the water. However, the SOLAS lifejacket offers virtually no thermal protection, and its clumsiness materially restricts the wearer's mobility.

An immersion suit is defined in the norm ISO/DIS 15027 1, 2, 3 as a suit intended to protect the wearer from the effects of immersion in cold water. There are two varieties of immersion suits, being constant wear suits (an immersion suit, designed to be routinely worn in anticipation of accidental immersion in cold water, but permitting physical activity by the wearer to such extent that actions may be undertaken without undue encumbrance. The suit can also be worn for foul weather protection) and abandonment suits (an immersion suit designed to permit rapid donning in the event of an imminent unintended immersion in cold water).

The difficulty resides in the making of such an immersion suit which shall meet the standards of thermal insulation (today's standard specifies that the body core temperature may not drop more than 1 degree Celsius per hour) as well as prevailing standards for buoyancy (when requested), and yet will fit most of the (adult) sizes without significant restriction of movement, and which also can be easily and correctly donned by an untrained wearer within one minute.

SUMMARY OF THE INVENTION

It is an object of the present invention to provide a thermally insulating floatation garment, such as a lifejacket or an immersion suit (including constant wear suits and abandonment suits), which offer a predetermined thermal insulation in water even when worn by persons of different sizes.

It is another object of the present invention to provide a lifejacket for use in emergency situations which provides the wearer buoyancy and thermal insulation.

It is yet another object of the present invention to provide a lifejacket for use in emergency situations which is capable of fitting a wide range of adult sizes.

It is yet a further object of the present invention to provide an immersion suit, in particular an abandonment suit, which allows the wearer increased freedom of movement as compared with conventional abandonment suits.

It is yet another object of the present invention to provide a constant wear suit which provides freedom of movement to the wearer whilst keeping to a minimum the flow of water into and out of the suit.

According to the present invention there is provided a floatation garment comprising an elastic layer shaped to fit at least around the torso of a wearer and to stretch to an extent between a minimum and a maximum depending on the size of the wearer, and a plurality of thermally insulating panels which are attached with respect to the elastic liner and/or with respect to one another such that they slidably overlap one another.

It will be understood that the thermally insulating panels are used in the floatation garment of the present invention to provide thermal insulation. They can be made of a material which provides thermal insulation but no or substantially no buoyancy such as for example the material of wet suits. Preferably, the thermally insulating panels are however made of a material which provides not only thermal insulation but which also gives buoyancy. In this way, the volume of other buoyant elements of the garment, such as an inflatable bladder which is preferable provided in the garment to provide buoyancy and to self-right a wearer even when he is unconscious, may be reduced. The thermally insulating panels may in particular be made of a foam material which is preferably enclosed in a cover. By reason of the panels being slidable relative to each other as the garment is stretched, it can fit a wide range of sizes without requiring any alterations or adjustments to be made to it. When the garment is worn by a small person it is not stretched to any significant extent and the thermally insulating panels overlap with each other to their fullest extent. As the size of the wearer increases the garment will stretch causing the foam panels to slide apart, but the wearer's torso remains enclosed by the foam panels.

The thermally insulating panels may be attached to one or both sides of the elastic layer. It is preferable to arrange the thermally insulating panels on an inner side of the elastic layer, i.e. on the side facing the wearer. In this way, these panels are pressed by the elastic layer against the wearer's body so that flow of water between the wearer's body and the thermally insulating panels is avoided and an effective thermal insulation can be achieved.

The elastic layer may comprise an elastic rubber layer, in particular a Neoprene layer, which is preferably lined on at least one side with a knitted stretch layer. The thermally insulating panels may comprise a foam panel, in particular a closed cell foam panel, which is preferably enclosed in a cover. The foam panels may for example be comprised of PU (polyurethane), PO (polyolefine), PVC (polyvinyl chloride), nitril rubber foam or of a mixture of these materials.

Preferably, the thermally insulating panels are arranged between an elastic inner lining material, which is worn against the skin, and the elastic layer. This inner lining protects the wearer's skin from chafing by the panels. It can also be used to fix one or more of the thermally insulating panels, in particular by stitching, to keep it on its place in the garment. Preferably, the inner lining is stitched or otherwise joined to the elastic layer along its edges to enclose the thermally insulating panels. The inner lining may be comprised of stretch elastane such as Lycra.

It is preferable that the thermally insulating panels overlap one another to form a continuous layer of thermally insulating material even when the elastic layer is stretched to the maximum extent or in other words to limit the stretch in the elastic layer or in other words in the garment so that the thermally insulating panels do not slide so far apart that they actually cease to overlap each other. This would leave thermally open areas in the garment through which heat would escape.

The floatation garment of the present invention can be designed to comfortably fit for example children having a height of 1.40 m or less and adults of varying build up to and including 101 kgs in weight and over and 1.96 m in height and over. Tests have shown that the garment can compensate at least for the indicated variation in size. Where required a junior version or a larger version of the floatation garment can also be provided.

The floatation garment may take the form of a lifejacket or of an immersion suit (including constant wear suits and abandonment suits). When used in both a constant wear suit or an abandonment suit the present invention has the advantage over the prior art of allowing considerable freedom of movement, whilst preventing, or at least minimising the free flow of water around the wearer's torso. This is because the thermally insulating panels slide freely over one another as the wearer moves around, but are still held close to the wearer's torso by the elastic layer.

When used as a lifejacket the floatation garment may take the form of a jerkin or sleeveless coat. Conveniently it also includes a crotch piece which allows it to be secured around the lower body and upper legs to protect the groin area. Preferably, the garment also comprises a spray hood and at least one inflatable bladder or chamber designed not only to provide additional buoyancy but also preferably to self-right an unconscious person.

When used as an immersion suit (including constant wear suits and abandonment suits) it may also comprise arms and legs. In a constant wear suit or an abandonment suit the garment may also be provided with an outer layer of hard wearing, waterproof material, such as Cordura, polyester, aramids or nylon.

Preferably, arm, neck and leg holes in the garment are elasticated to form a tight seal when worn and thereby prevent or, at least minimise, the flow of water under and through the garment. To secure the garment when worn, belts, straps and webbing may be provided. To prevent or minimise flow of water between the garment and the wearer's body, one free edge portion of the elastic layer preferably overlaps the opposite free edge portion of the elastic layer over a distance depending on the size of the wearer and the garment comprises a closure enabling to secure both free edge portions to one another for different distances of overlapping, the closure comprising in particular touch and go fasteners such as Velcro strips.

An embodiment of the present invention will now be described, by way of example, with reference to the accompanying drawings, in which:

DETAILED DESCRIPTION OF THE INVENTION

Figure 1:
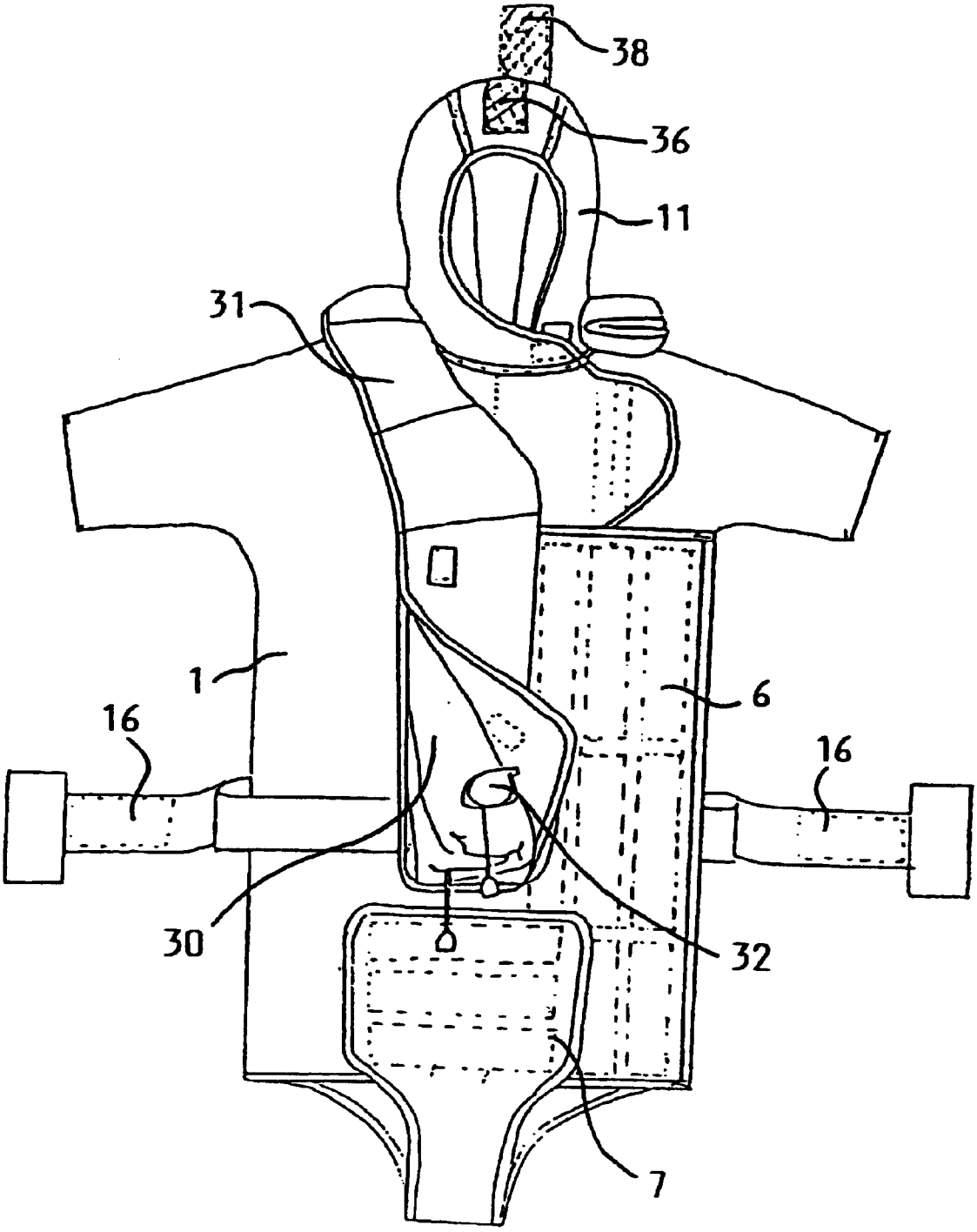
FIG. 1 is a schematic front view of a lifejacket, with closed front flap, embodying the present invention.
Figure 2:
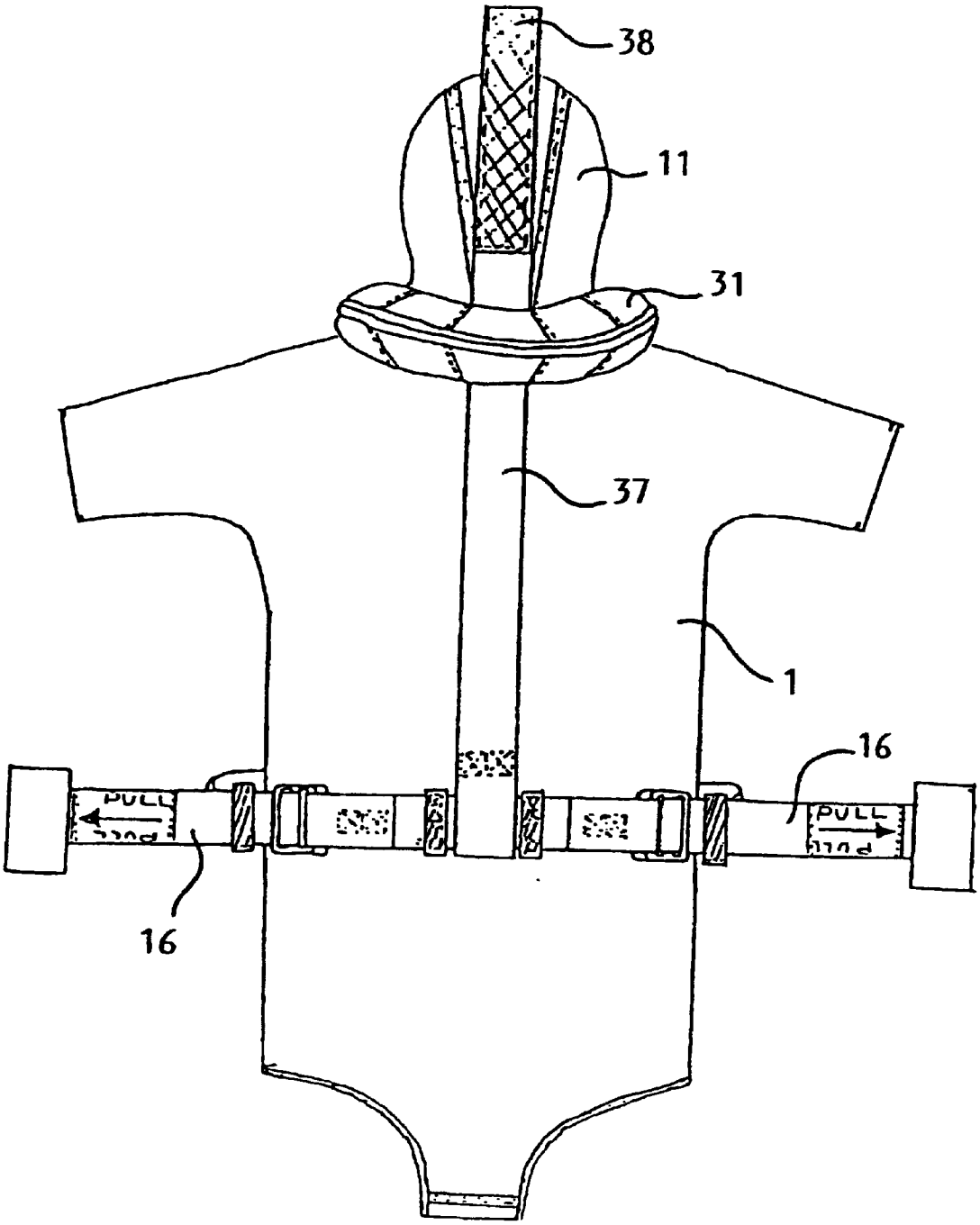
FIG. 2 is a schematic back view on the lifejacket illustrated in FIG. 1.
Figure 5A:
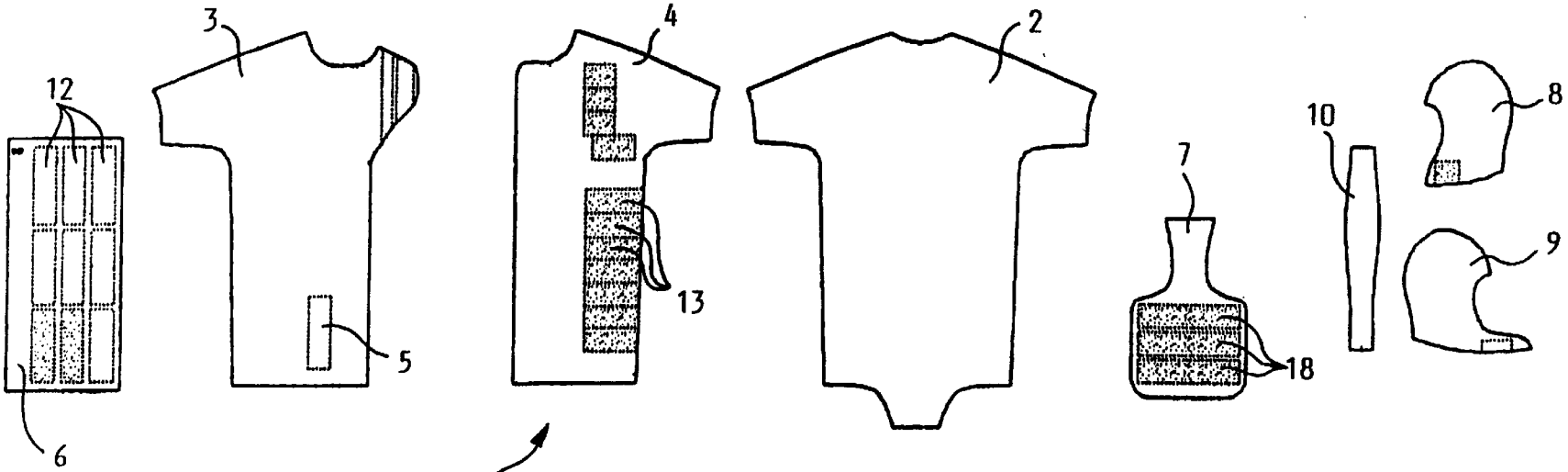
FIGS. 5*a,* 5*b* and 5*c* show the pattern pieces composing the lifejacket illustrated in the previous Figures, FIG. 5*a* showing in particular the pattern pieces composing the elastic outer layer, FIG. 5*b* the pattern pieces composing the elastic lining and FIG. 5*c* the pattern pieces composing the thermally insulating panels.

Referring to FIGS. 1 and 2 and to the pattern pieces of the elastic outer layer 1 (a rubber layer, in particular elastic Neoprene lined on both sides with a knitted stretch layer) on FIG. 5*a* the body of the lifejacket takes the form of a jerkin having a back piece 2 and two side pieces, namely a front right piece 3 and a front left piece 4. The back piece 2 is joined, in particularly stitched, to each of the side panels 3, 4 at the shoulder and the side to form an arm hole and a collar. FIG. 5*a* also shows a front flap 6, a crotch piece 7 and three pieces 8–10 composing the hood 11.

Figure 3:
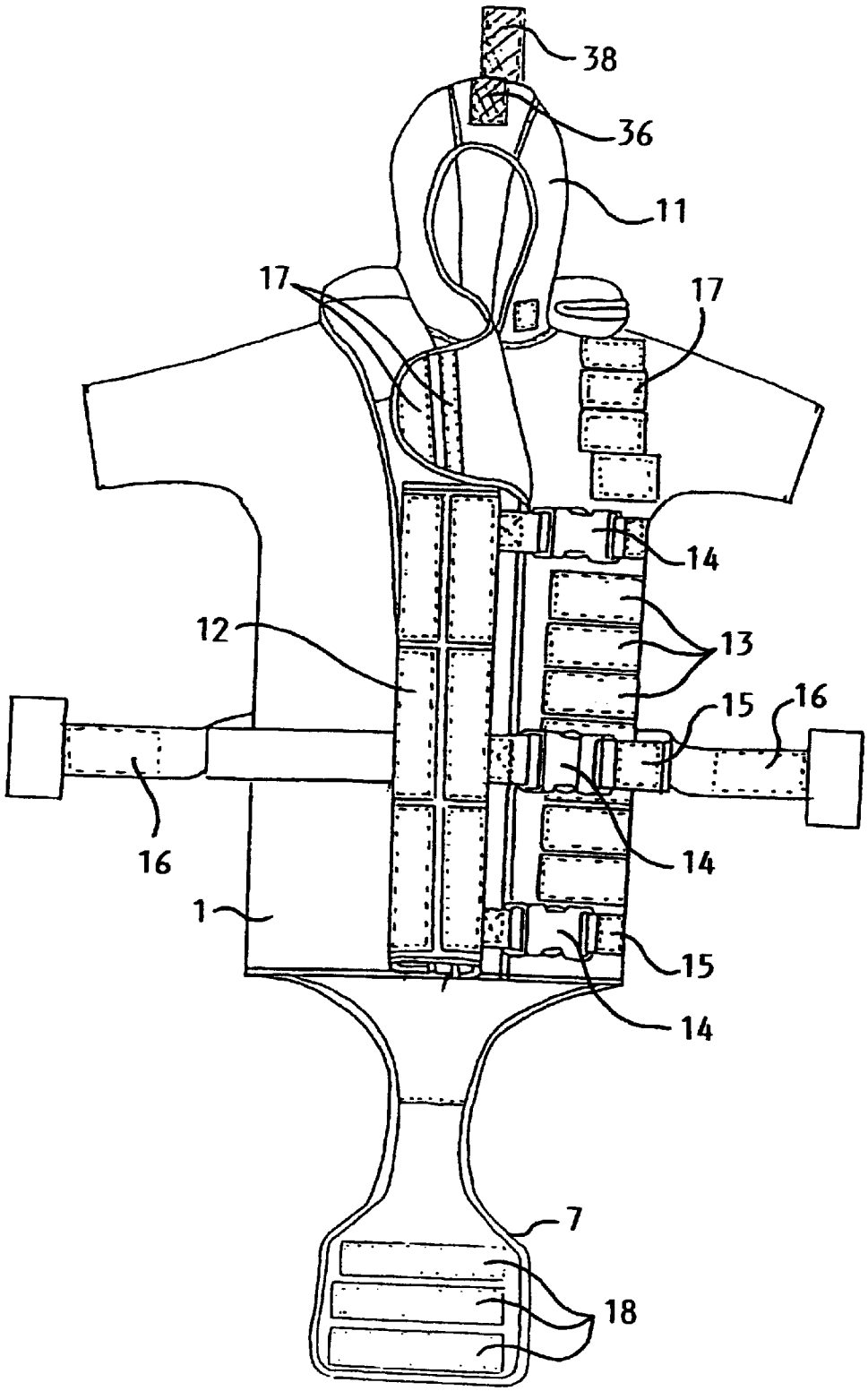
FIG. 3 is a schematic front view of the lifejacket illustrated in FIG. 1 with open front flap.

The front flap 6 is stitched to the front right piece 2 of the elastic outer layer 1 and is provided on its inner side with three rows of touch and go fasteners, in particular with three rows of Velcro strips 12. When the garment is closed as illustrated in FIG. 1, the front flap 6 which forms a free edge portion of the elastic outer layer 1, overlaps the opposite free edge portion of this outer layer 1 over a distance which depends on the size of the wearer. As can be seen clearly in FIG. 3, the opposite free edge portion of the elastic outer layer 1 is provided with a series of parallel elastic Velcro strips 13 to close the lifejacket. Both the rows of Velcro strips 12 and the series of Velcro strips 13 have a width such as to enable to secure both free edge portions of the lifejacket to one another for different distances of overlapping so that the lifejacket can be worn by persons of different size. Before closing the front flap, the lifejacket can be closed by means of plastic buckles 14 connected with elastic or adjustable webbing 15 to both free edges of the elastic outer layer. When the front flap 6 is fastened by the Velcro strips 12, 13, over these buckles 14, the lifejacket can further be closed by a main webbing 16. It will be clear that the Velcro strips contribute in fastening the lifejacket but especially in preventing flow of water into the lifejacket. As can be seen in FIGS. 3 and 5*a,* additional Velcro strips 17 are provided above the front flap 6 on the front right piece 3 and on the front left piece 4 of the elastic layer to avoid flow of water in the lifejacket.

The crotch piece 7 is stitched to the back piece 2 of the elastic layer and is provided with three Velcro strips 18 to fasten it to a Velcro strip 5 provided on the front right piece 3 of the elastic layer 1 to protect the groin area of the wearer.

Figure 5B:
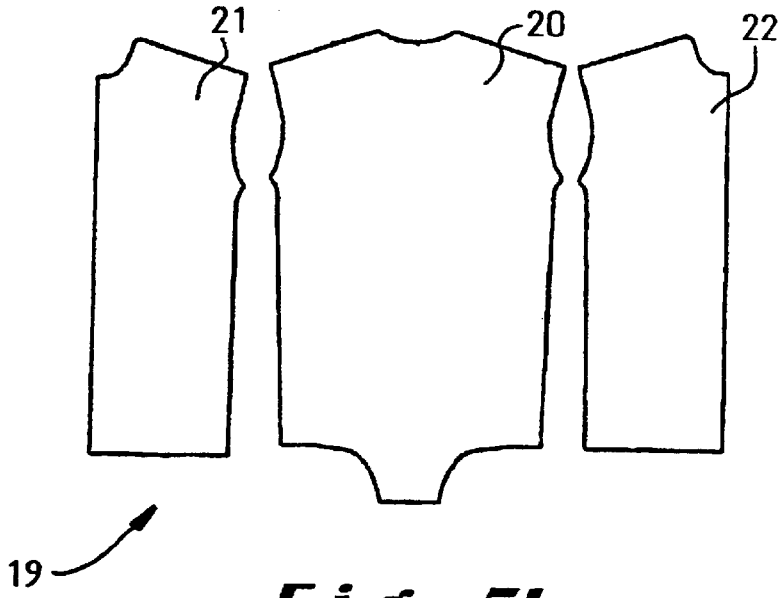

As shown on FIG. 5*b* the lifejacket comprises an inner stretch (elastic) lining 19 composed of a back piece 20 and two side pieces, namely a front right piece 21 and a front left piece 22. The different pieces of the stretch lining 19 are stitched together. The inner elastic lining layer 19 is further joined along its edges to the elastic outer layer 1 by an elastic binding by lock stitching.

Figure 5C:
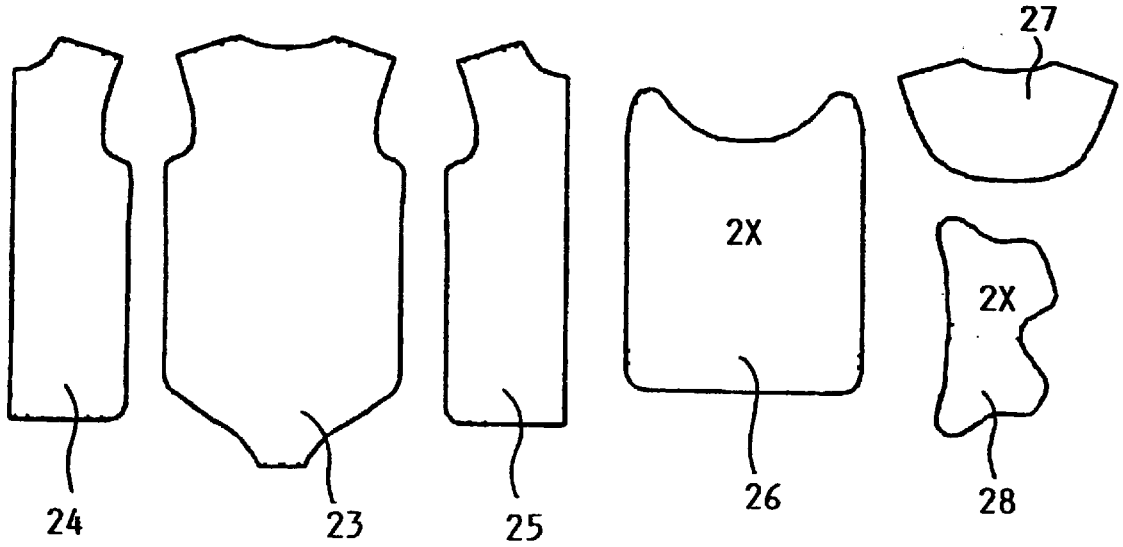

According to the invention, the lifejacket further comprises a plurality of thermally insulating panels which are attached with respect to the elastic layer 1 and/or with respect to one another such that they slidably overlap one another. In this way, an effective thermal insulation can be assured with thermally insulating plates which are not or at least not sufficiently elastic to fit around persons of a different size. The plates used in the lifejacket illustrated in the figures are shown in FIG. 5*c* and comprise a back panel 23, a front right panel 24, a front left panel 25, two side panels 26, an upper back panel 27 and two shoulder panels 28. Each of these panels is composed of a foam layer enclosed in a cover to reduce the frictional forces and to enable a stronger fixation of the panels, in particular to the elastic straps described further hereinafter.

Figures 6, 7, 8, 9, 10:
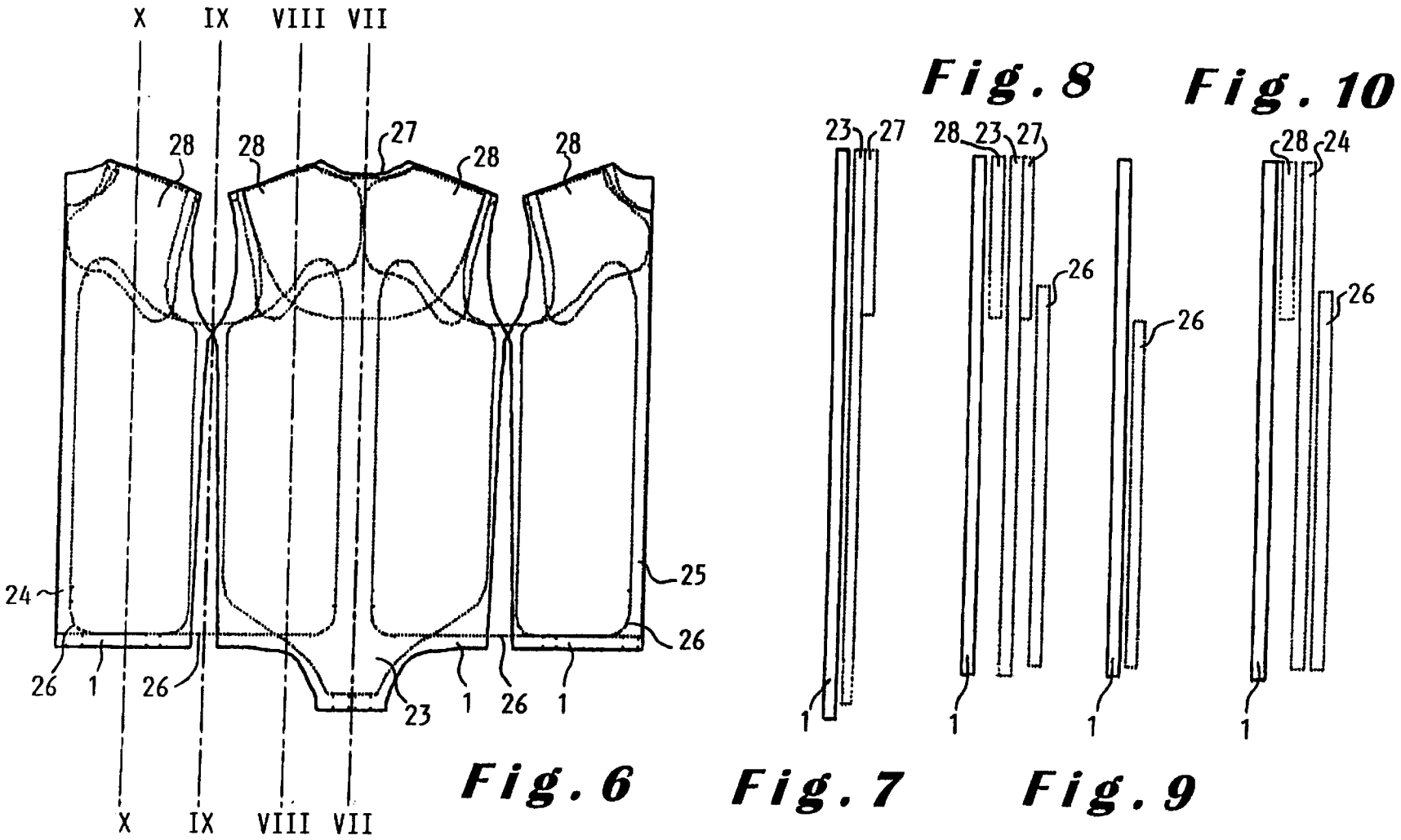
FIG. 6 shows a back view on the elastic layer of the lifejacket illustrated in the previous figures and, in dotted lines, the position of the different thermally insulating panels.
FIGS. 7 to 10 show schematic cross sections along lines VII—VII, VIII—VIII, IX—IX and X—X indicated in FIG. 6. The continuous line indicates the outer elastic layer; the dotted lines indicate the insulating panels. Note that the upper back panel is stitched on the main back panel (see FIGS. 7 and 8 wherein this is illustrated by leaving no gap between these panels whereas the other panels and the elastic outer layer are separated by a gap)

In the lifejacket illustrated in the figures, the thermally insulating panels are arranged on an inner side of the elastic outer layer 1 so that the water is prevented or at least hampered from flowing between the body and the panels. The panels are more particularly arranged between the elastic outer layer 1 and the stretch inner lining 19. FIG. 6 shows how the thermally insulating panels are positioned onto the pieces 2–4 of the elastic outer layer 1, the extremities of the pieces 2–4 which extend beyond the inner stretch lining 19 have been omitted. Moreover, since FIG. 6 is a top plan view on the flat pieces of the elastic outer layer, these pieces have not been stitched to one another but are separated by a gap. In the cross-sectional views of FIGS. 7 to 10, the pieces of the outer elastic layer 1 have however been stitched together.

It will be readily apparent from FIGS. 6 to 10 that the foam panels overlap one another to form a continuous layer of thermally insulating material throughout the lifejacket. This layer is only one thickness of foam thick at the sides (see FIG. 9), but over the remainder of the garment the layer is typically two thickness of foam thick.

Figure 11:
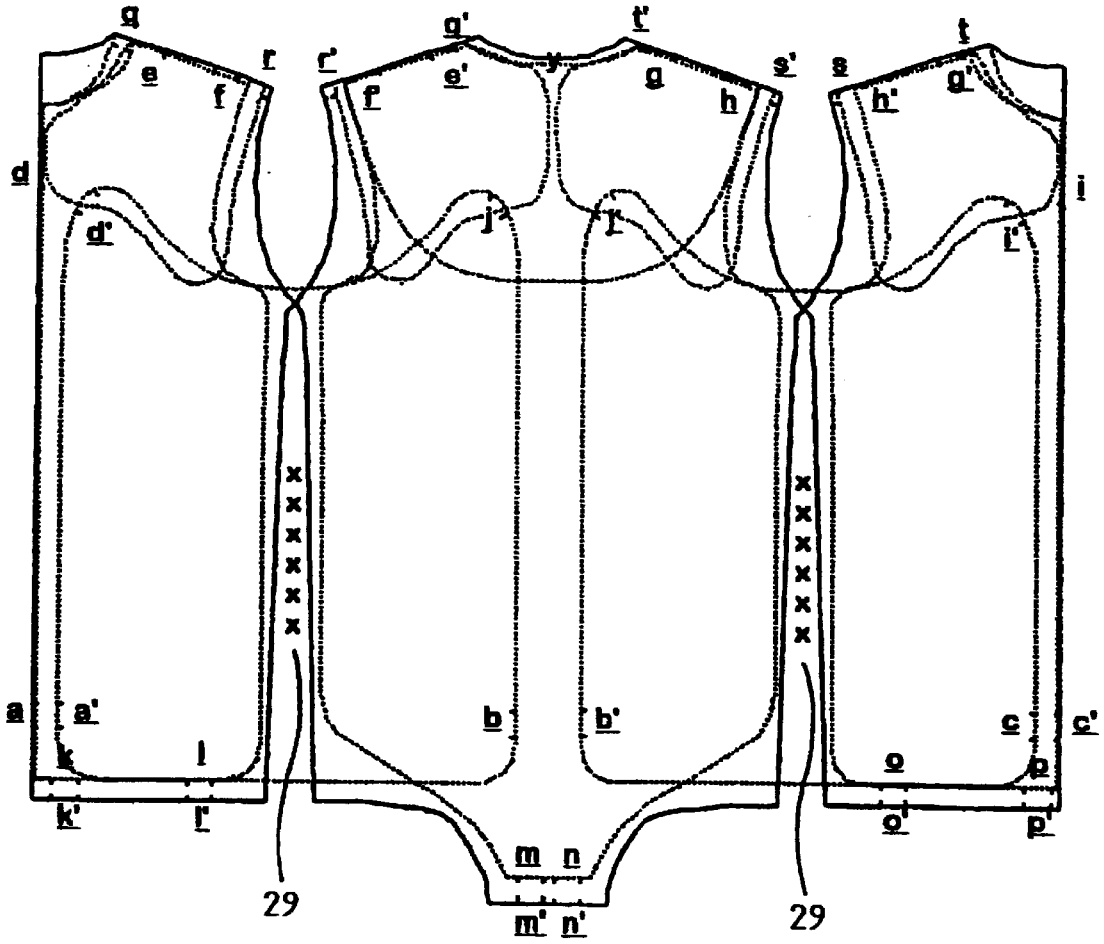
FIG. 11 shows the fixation of the sliding panels by stitching and/or elastics.

FIG. 11 is a view similar to the view of FIG. 6 but illustrates how the foam panels are fixed between the outer elastic layer 1 and the inner stretch lining 19. At the side seam of the lifejacket, the side panels 26 are stitched directly to the inner stretch lining 19 by means of stitches the location of which is indicated by crosses 29 and at position y the upper back panel 27 is stitched to the back panel 23. The thermally insulating panels are further attached to one another and to the elastic outer layer 1 by means of elastic straps which keep the panels in their position but which do not prevent the required mutual sliding of these panels. The locations where the elastic straps are stitched to the panels or to the outer layer are indicated in FIG. 11 by the letters a-a' to t-t':

a-a': connection between side panel 26 and the stitching between inner liner 19 and front right piece 3
b-b': connection between side panels 26
c-c': connection between side panel 26 and the stitching between inner liner 19 front left piece 4
d-d': connection between side panel 26 and the stitching between inner liner 19 front right piece 3
e-e': connection between shoulder panel 28 and neckseam
f-f': connection between shoulder panel 28 and upperarm-seam
g-g': connection between shoulder panel 28 and neckseam
h-h': connection between shoulder panel 28 and upperarm-seam
i-i': connection between side panel 26 and the stitching between inner liner 19 front left piece 4
j-j': connection between side panels 26
k-k': connection between the front right panel 24 and the hem
l-l': connection between the front right panel 24 and the hem
m-m': connection between the back panel 23 and the crotch piece seam
n-n': connection between the back panel 23 and the crotch piece seam
o-o': connection between the front left panel 24 and the hem
p-p': connection between the front left panel 24 and the hem
q-q': connection between the front right panel 24 and the back panel 23
r-r': connection between the front right panel 24 and the back panel 23
s-s': connection between the front left panel 25 and the back panel 23
t-t': connection between the front left panel 25 and the back panel 23

When the lifejacket is put on the inner elastic lining 19 stretches to accommodate the wearer. With small adults the outer (Neoprene) layer 1 is not stretched to any significant extent and therefore the foam panels retain the configuration shown in the drawings. However, as the size of the wearer increases the outer (Neoprene) layer 1 is stretched and the foam panels are pulled apart. The foam panels are attached in such a way by stitching and by means of elastic straps with respect to the outer (Neoprene) layer that this movement of the panels relative to one another is in no way impeded. The full size which can be accommodated by the lifejacket is reached when the panels cease to overlap.

Figure 12:
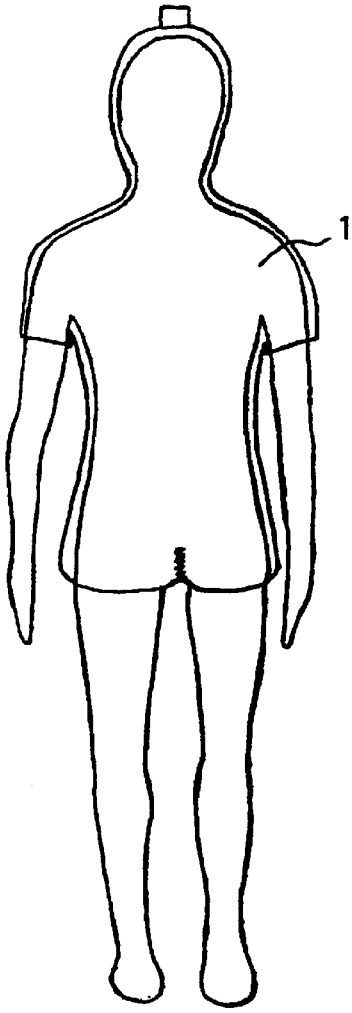
FIGS. 12 to 14 are schematic illustrations of a person wearing a lifejacket as shown in FIG. 1 showing respectively the back, the left hand side and the front of the person.
Figure 13:
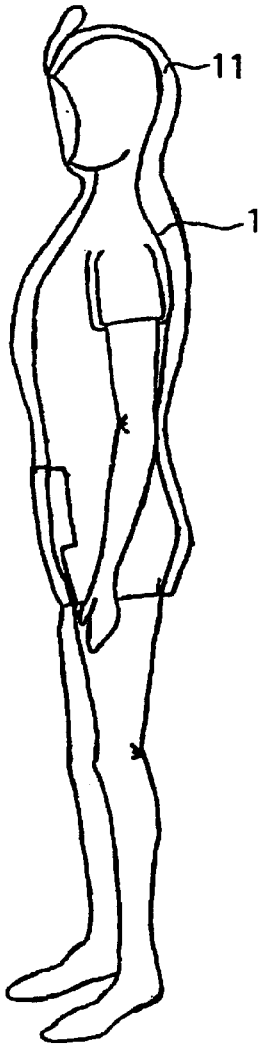
Figure 14:
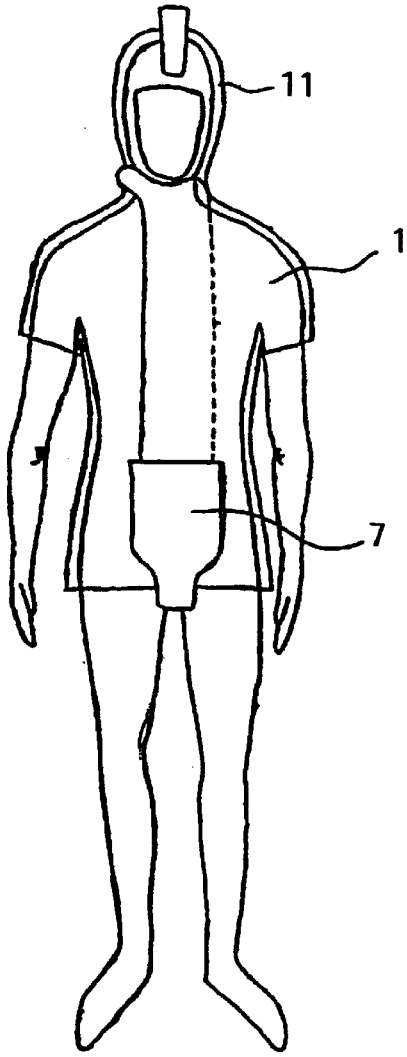

Referring to FIGS. 12–14 there is shown a schematic illustration of someone wearing a lifejacket according to the present invention. It will be seen that the lifejacket fits tightly around the upper arms and legs, and further that a spray hood 11 has been provided. It is essential to keep to a minimum any flushing of water through the lifejacket as this will carry heat away from the body to circumvent the effective thermal insulation provided by the foam panels. The two front panels overlap over the front of the torso and are joined together by flaps which provide a water barrier. The foam panels at the lower edge of the garment form a continuous skirt around the groin, hips and buttocks of the wearer which skirt is pulled in tight by a flap which passes from the back under the crotch and is secured at the front.

Where the garment takes the form of an immersion suit arms and legs are provided. These arms and legs form extensions of the outer layer. The outer layer may be made of Neoprene, but as an alternative to this it can be made of a hard wearing waterproof material such as Cordura or polyester or nylon or aramids, . . .

Figure 4:
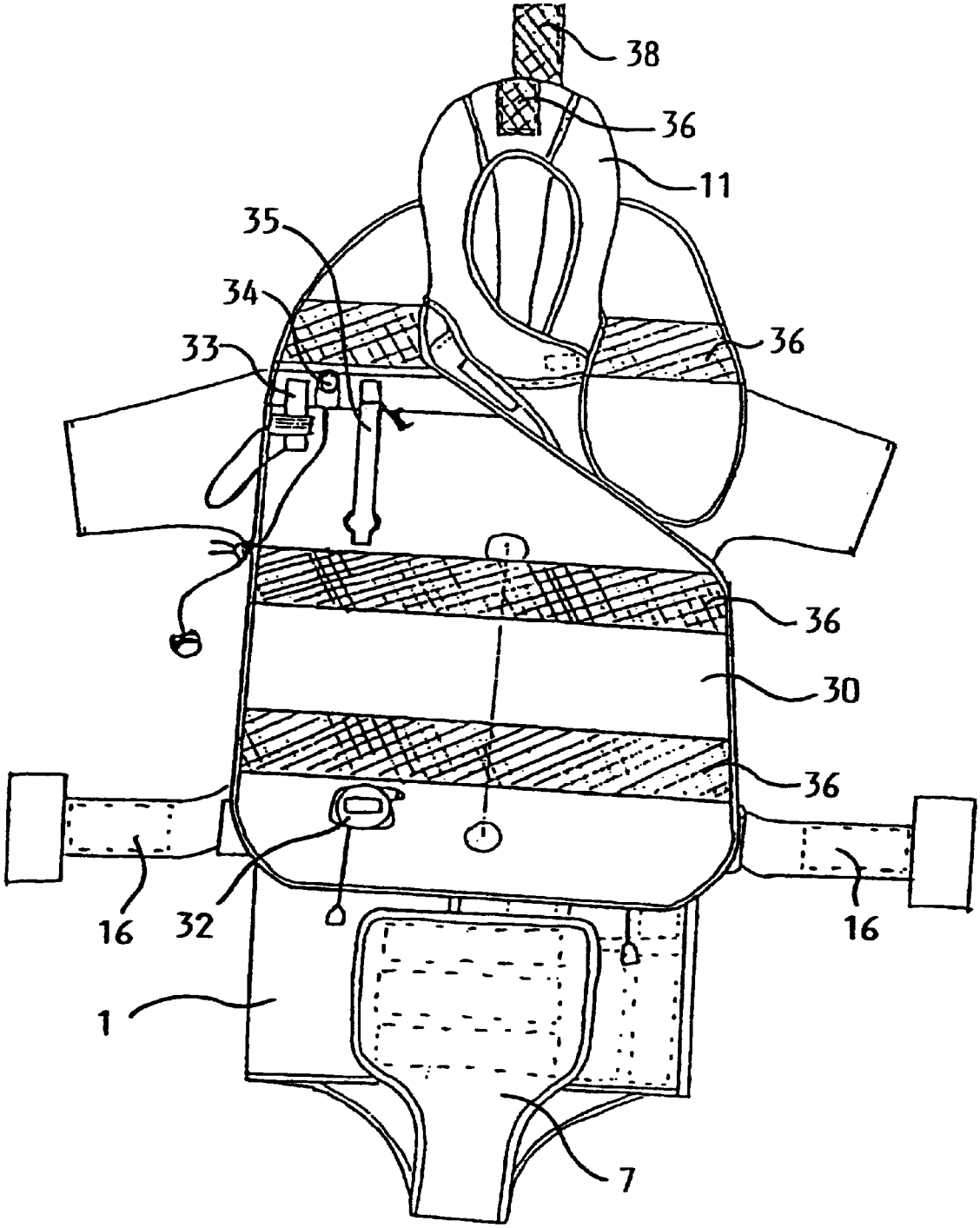
FIG. 4 is a schematic front view of the lifejacket illustrated in FIG. 1 with unfolded inflatable bladder.

The thermally insulating panels used in the lifejacket described hereabove are preferably made of a buoyant material such as for example a closed cell foam. The preferably have such a volume such as to keep a wearer floating in water. To increase the buoyancy of the lifejacket, or to provide the required buoyancy in case the volume of the thermally insulating panels would be too small, it comprises preferably at least one inflatable bladder 30 which extends preferably around the head of the wearer to form a stole keeping the head sufficiently high out of the water. In FIG. 1, this bladder 30 is illustrated as being folded away in a cover 31 provided on the front of the lifejacket, more particularly on the front right piece 3 of the elastic outer layer 1. FIG. 4 shows the inflatable bladder 30 in its unfolded but not yet inflated state. As can be seen on this figure, it comprises an automatic inflator 32, a whistle 33, a light 34 and an over pressure valve/oral tube 35. The lifejacket is further provided with retroreflective tapes 36 and a webbing 37 extending over the back of the lifejacket and forming a loop 38 on top of the hood 11.

What is claimed is:

1. A flotation garment, characterised in that it comprises at least one elastic layer shaped to fit at least around the torso of a wearer and to stretch to an extent between a minimum and a maximum depending on the size of the wearer, and a plurality of thermally insulating panels which are arranged on an inner side of the elastic layer, said inner side facing the wearer, and which are locally attached with respect to the elastic layer and/or with respect to one another such that at least a number of them slidably overlap one another and so that, upon stretching of the elastic layer, a sliding movement of at least part of this elastic layer relative to the insulating panels is achieved.

2. A flotation garment according to claim 1, characterised in that the thermally insulating panels are arranged between an elastic inner lining material and the elastic layer.

3. A flotation garment according to claim 2, characterised in that at least one of said panels is fixed to the elastic inner lining material, in particular by stitching.

4. A flotation garment according to claim 2, characterised in that the elastic inner lining material is joined along its edges to the elastic layer.

5. A flotation garment according to claim 1, characterised in that at least a number of the thermally insulating panels are attached to one another by means of elastic straps.

6. A flotation garment according to claim 5, characterised in that at least a number of the thermally insulating panels are attached to the elastic layer by means of further elastic straps.

7. A flotation garment according to claim 1, characterised in that the thermally insulating panels overlap one another to form a continuous layer of thermally insulating material arranged to cover the wearer's torso substantially completely.

8. A flotation garment according to claim 1, characterised in that the thermally insulating panels overlap one another to form a continuous layer of thermally insulating material even when the elastic layer is stretched to said maximum extent.

9. A flotation garment according to claim 1, characterised in that the thermally insulating panels are made of a buoyant material.

10. A flotation garment according to claim 9, wherein said thermally insulating panels have a volume such as to keep a wearer floating in water.

11. A flotation garment according to claim 1, characterised in that it comprises at least one inflatable bladder.

12. A flotation garment according to claim 1, characterised in that the thermally insulating panels comprise a foam panel, in particular a closed cell foam panel.

13. A flotation garment according to claim 1, characterised in that the elastic layer comprises an elastic rubber layer, which is lined on at least one side with a knitted stretch layer.

14. A flotation garment according to claim 1, characterised in that it comprises a hood made of the same material as said elastic layer.

15. A flotation garment according to claim 1, characterised in that it comprises a crotch piece fixed to a back portion of the garment and provided with means to releasably secure it to a front portion of the garment.

16. A flotation garment according to claim 1, characterised in that it comprises arm sleeves to protect at least the armpits, which arm sleeves are made of the same material as said elastic layer.

17. A flotation garment, characterised in that it comprises at least one elastic layer shaped to fit at least around the torso of a wearer and to stretch to an extent between a minimum and a maximum depending on the size of the wearer, and a plurality of thermally insulating panels arranged on an inner side of the elastic layer and locally attached with respect to the elastic layer and/or with respect to one another such that at least a number of them slidably overlap one another and so that, upon stretching of the elastic layer, a sliding movement of at least part of this elastic layer relative to the insulating panels is achieved, and in that when the garment is donned by a wearer, one free edge portion of the elastic layer overlaps the opposite free edge portion of the elastic layer over a distance depending on the size of the wearer and in that it comprises a closure enabling to secure both free edge portions to one another for different distances of overlapping.

18. A flotation garment according to claim 17, wherein the closure comprises touch and go fasteners.

* * * * *